US007546079B2

(12) United States Patent
Katada et al.

(10) Patent No.: US 7,546,079 B2
(45) Date of Patent: Jun. 9, 2009

(54) FIXING APPARATUS AND IMAGE FORMING APPARATUS INCLUDING A CONTACT TYPE TEMPERATURE SENSOR PLACED STABLY ON A PAPER NON-PASSING ZONE OF A FIXING MEMBER

(75) Inventors: Kazunori Katada, Hino (JP); Masami Maruko, Hachioji (JP); Masakazu Nakamura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/825,333

(22) Filed: Jul. 5, 2007

(65) Prior Publication Data

US 2008/0031661 A1 Feb. 7, 2008

(30) Foreign Application Priority Data

Aug. 4, 2006 (JP) ..... 2006-212982

(51) Int. Cl.
*G03G 15/20* (2006.01)

(52) U.S. Cl. ..... 399/329; 399/328; 399/330

(58) Field of Classification Search ..... 399/329
See application file for complete search history.

(56) References Cited

U.S. PATENT DOCUMENTS 6,239,411 B1 * 5/2001 Ito ..... 219/216
2005/0141914 A1 * 6/2005 Hiraoka et al. ..... 399/69
2005/0220510 A1 * 10/2005 Tsunoda ..... 399/329
2006/0088326 A1 * 4/2006 Nakayama ..... 399/69

FOREIGN PATENT DOCUMENTS

JP 2005-163837 A 6/2005

* cited by examiner

*Primary Examiner*—David M Gray
*Assistant Examiner*—G. M. Hyder
(74) *Attorney, Agent, or Firm*—Frishauf, Holtz, Goodman & Chick, P.C.

(57) ABSTRACT

There is described a fixing apparatus for fixing a toner image onto a recording material, which makes it possible not only to reduce the frictional resistance generated between a temperature sensor and a heating member, but also to prevent occurrences of abnormal sounds and breaking of the wire coupled to the temperature sensor, both caused by the direct contact between them. The fixing apparatus includes: a heating member provided with a surface layer, which is elastically deformable and includes the paper sheet passing area and the paper sheet non-passing area; a pressing member that press-contacts the heating member; and a temperature sensor that contacts the paper sheet non-passing area of the surface layer. A surface roughness Ra of the paper sheet non-passing area is set at such a value that is larger than that of a paper sheet passing area.

16 Claims, 4 Drawing Sheets

FIXING APPARATUS AND IMAGE FORMING APPARATUS INCLUDING A CONTACT TYPE TEMPERATURE SENSOR PLACED STABLY ON A PAPER NON-PASSING ZONE OF A FIXING MEMBER

This application is based on Japanese Patent Application No. 2006-212982 filed on Aug. 4, 2006 with Japan Patent Office, the entire content of which is hereby incorporated by reference.

BACKGROUND OF THE INVENTION

The present invention relates to a fixing apparatus to be used for an image forming operation employing the electrophotographic method and an image forming apparatus provided with the fixing apparatus mentioned in the above.

In the image forming apparatus that employs the electrophotographic method, an image is formed on a recording medium by conducting the steps of: forming a latent image on a photoreceptor member; developing the latent image with toner; transferring the toner image formed on the photoreceptor member onto the recording medium; and fixing the transferred toner image onto the recording medium by applying heat and pressure to both the toner image and the recording medium.

The fixing operation is achieved in such a manner that the recording medium bearing the toner image is introduced into a nip portion formed between a heating member and a pressing member, so as to fuse the toner image at the nip portion by applying heat and pressure. Accordingly, a resin of tetrafluorethylene-perfluoroalkyl vinyl ether copolymer (PFA), having both release and heat-resisting properties, is frequently employed for a surface layer of the heating member, which directly contact the toner image.

In the image forming apparatus that forms a toner image including a relatively large amount of toner, such as a full color toner image or the like, it is desirable that a flexible surface layer is formed on the heating member, so that the surface layer of the heating member flexibly deforms corresponding to surface unevenness formed by the protrusions of toner image, so as to uniformly heat the toner image.

Patent Document 1 (Tokkai 2005-163837, Japanese Non-Examined Patent Publication) sets forth the PFA, having a measuring value of elastic modulus (G') being equal to or smaller than 60 MPa, measured at 100° C. by the dynamic viscoelasticity measuring apparatus (ARES), as the surface layer that complies with the condition mentioned in the above.

According to the fixing operation employing the heating member having the surface layer set forth in Patent Document 1, since the uniform fixing operation is conducted allover the image, it becomes possible to form a high quality color image on the recording medium.

To control the surface temperature of the heating member and/or to prevent the heating member from overheat, the fixing apparatus is usually provided with a temperature sensor to detect the continuous transition of the surface temperature of the heating member and/or anther type temperature sensor, such as a thermostat, a thermal fuse, etc., to detect the fact that the surface temperature exceeds a predetermined value.

Although both contact type and noncontact type temperature sensors are available in the market, a contact type temperature sensor is frequently employed to reduce the cost of the apparatus. Accordingly, the contact type temperature sensor is usually employed in the apparatus, except that the noncontact type temperature sensor is selectively employed at a paper sheet passing region in which the heating member contact the recording medium.

Although a good fixing operation can be achieved by forming the flexible and deformable surface layer on the surface of the heating member as mentioned in the above, when the heating member is activated while the temperature sensor is made to contact the flexible surface layer, it has been revealed that various kinds of defects, such as an occurrence of abnormal sounds, breaking of a wire coupled to the temperature sensor, an increase of driving torque for driving the heating member, etc., could be generated, since the temperature sensor interlocks with the surface layer due to the deformation of the surface layer, caused by the close contact between the temperature sensor and the surface layer of the heating member.

SUMMARY OF THE INVENTION

The present invention can be attained by the fixing apparatus and the image forming apparatus described as follows.

(1) According to a fixing apparatus reflecting an aspect of the present invention, the fixing apparatus for fixing an image onto a recording material, comprises: a heating member that is provided with a surface layer, which is elastically deformable and includes a paper sheet passing area that directly contacts the recording material and a paper sheet non-passing area that does not contact the recording material; a pressing member that press-contacts the heating member; and a temperature sensor that contacts the paper sheet non-passing area of the surface layer; wherein a value of a surface roughness Ra of the paper sheet non-passing area is larger than that of the paper sheet passing area.

(2) According to an image forming apparatus reflecting another aspect of the present invention, the image forming apparatus comprises: an image forming section to form a toner image on a recording material; and a fixing apparatus to fix the toner image onto the recording material; wherein the fixing apparatus includes: a heating member that is provided with a surface layer, which is elastically deformable and includes a paper sheet passing area that directly contacts the recording material and a paper sheet non-passing area that does not contact the recording material; a pressing member that press-contacts the heating member; and a temperature sensor that contacts the paper sheet non-passing area of the surface layer; wherein a value of a surface roughness Ra of the paper sheet non-passing area is larger than that of the paper sheet passing area.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
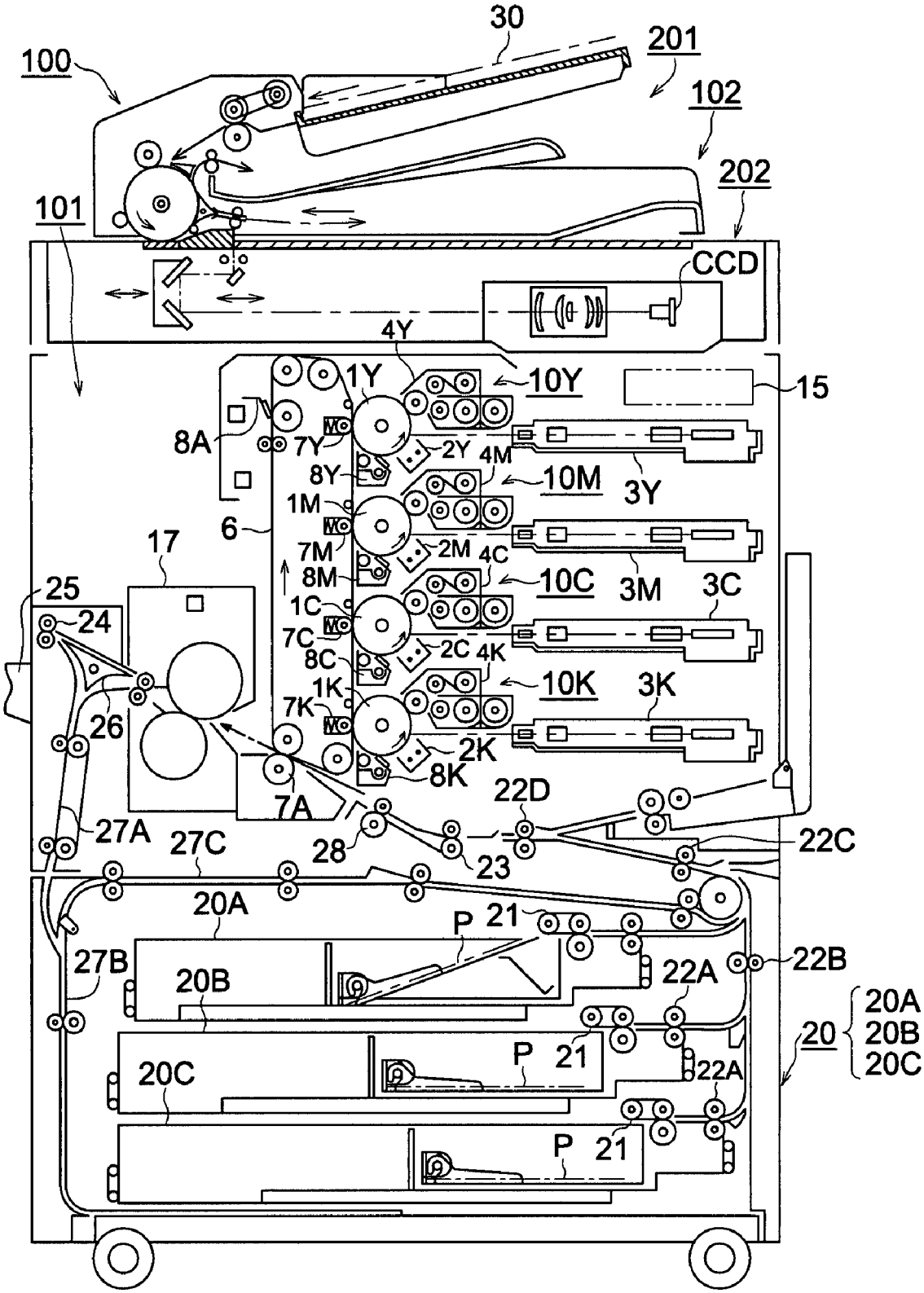
FIG. 1 shows a schematic diagram of an overall configuration of an image forming apparatus embodied in the present invention.

Referring to the drawings, the embodiment of the present invention will be detailed in the following. However, the scope of the present invention is not limited to the embodiment described in the following.

An image forming apparatus 100 shown in FIG. 1 is an example of color image forming apparatus, which forms a color image based on arbitral image data. The image forming apparatus 100 is constituted by an image forming section 101, a paper sheet conveying section, a fixing apparatus 17, a paper sheet feeding section 20 and an image reading apparatus 102. The image reading apparatus 102 includes an automatic document feeder 201 and a document image scanning-and-exposing apparatus 202, and is disposed above the image forming section 101. A document 30 placed on a document placing plate of the automatic document feeder 201 is conveyed by a conveyance mechanism, and images residing on a single side or both sides of the document 30 are scanned and exposed by the optical system of the document image scanning-and-exposing apparatus 202, so that a line image sensor CCD reads incident light representing the document images.

Analogue image signals generated by the photoelectronic converting actions performed in the line image sensor CCD are inputted into an image processing section (not shown in the drawings), in order to apply various kinds of image processing, such as an analogue processing, an analogue-to-digital conversion processing, a shading correction processing, an image compression processing, etc., so as to generate digital image data "n". Successively, the digital image data "n" are further converted into plural image data sets for unicolors Y (Yellow), M (Magenta), C (Cyan), BK (Black), and then, the plural image data sets are inputted into image writing units 3Y, 3M, 3C, 3K (hereinafter, also referred to as exposing devices 3Y, 3M, 3C, 3K), respectively.

The automatic document feeder 201 mentioned in the above is provided with an automatic duplex document conveying function. Concretely speaking, the automatic document feeder 201 can continuously and correctively read contents of the document 30 including a large number of paper sheets currently conveyed on the document placing plate, so as to store the contents of the document 30 into a storage (electronic RDH function). This electronic RDH function is conveniently employed in such the case that the contents of the document 30 including the large number of paper sheets should be copied by employing a copy function, or such the case that the document 30 including the large number of paper sheets should be transmitted by employing a facsimile function.

The image forming section 101 includes image forming units (image forming systems) 10Y, 10M, 10C, 10K, each of which has an image forming member for forming each of unicolor images Y, M, C, BK. The paper sheet conveying section includes a plurality of conveyance rollers for conveying a recording material P fed from the paper sheet feeding section 20 and a paper sheet re-feeding mechanism (ADU mechanism).

The paper sheet feeding section 20 is disposed below the image forming section 101. Further, the paper sheet feeding section 20 is constituted by, for instance, three paper sheet feeding cassettes 20A, 20B, 20C.

The image forming unit 10Y for forming a toner image of color Y (Yellow) includes a photoreceptor drum 1Y serving as an image forming element for forming the toner image of color Y, and further includes a charging device 2Y, an exposing device 3Y, a developing device 4Y and a cleaning device 8Y for cleaning the image forming element, all of which are disposed at respective positions in the peripheral space around the circumferential surface of the photoreceptor drum 1Y.

Further, the image forming unit 10M for forming a toner image of color M (Magenta) includes a photoreceptor drum 1M serving as an image forming element for forming the toner image of color M, and further includes a charging device 2M, an exposing device 3M, a developing device 4M and a cleaning device 8M for cleaning the image forming element, all of which are disposed at respective positions in the peripheral space around the circumferential surface of the photoreceptor drum 1M. Still further, the image forming unit 10C for forming a toner image of color C (Cyan) includes a photoreceptor drum 1C serving as an image forming element for forming the toner image of color C, and further includes a charging device 2C, an exposing device 3C, a developing device 4C and a cleaning device 8C for cleaning the image forming element, all of which are disposed at respective positions in the peripheral space around the circumferential surface of the photoreceptor drum 1C. Yet further, the image forming unit 10K for forming a toner image of color K (Black) includes a photoreceptor drum 1K serving as an image forming element for forming the toner image of color K, and further includes a charging device 2K, an exposing device 3K, a developing device 4K and a cleaning device 8K for cleaning the image forming element, all of which are disposed at respective positions in the peripheral space around the circumferential surface of the photoreceptor drum 1K.

Each pair of the charging device 2Y and the exposing device 3Y, the charging device 2M and the exposing device 3M, the charging device 2C and the exposing device 3C, and the charging device 2K and the exposing device 3K, constitutes a latent image forming section. The reversal developing method, in which a developing bias generated by superimposing an AC voltage onto a DC voltage having the same polarity as that of the toner currently used (negative polarity in the present embodiment) is applied, is employed in the developing operation to be conducted in each of developing devices 4Y, 4M, 4C, 4K. An intermediate transfer belt 6 is threaded on a plurality of rollers, so as to support the intermediate transfer belt 6 in such a manner that it can circulate around the plurality of rollers. Accordingly, the toner images of colors Y, M, C, BK respectively formed on the photoreceptor drums 1Y, 1M, 1C, 1K can be sequentially transferred onto the intermediate transfer belt 6.

Now, the image forming process will be briefly described in the following. The toner images of colors Y, M, C, BK respectively formed on the photoreceptor drums 1Y, 1M, 1C, 1K by the image forming units 10Y, 10M, 10C, 10K are sequentially transferred onto the intermediate transfer belt 6, currently circulating along the image forming units 10Y, 10M, 10C, 10K, by primary transferring rollers 7Y, 7M, 7C, 7K (primary transferring operation) onto which a primary transferring bias (not shown in the drawings) having a polarity opposite to that of the toner currently used (positive polarity in the present embodiment), so as to form a superimposed color image (namely, a full color toner image). Then, the full color toner image residing on the intermediate transfer belt 6 is further transferred onto the recording material P.

The recording material P accommodated in any one of the paper sheet feeding cassettes 20A, 20B, 20C is picked up by a pickup roller 21, which is provided in each of the paper sheet feeding cassettes 20A, 20B, 20C, and then, is conveyed to a secondary transferring roller 7A through pairs of conveyance rollers 22B, 22C, 22D, pairs of registration rollers 23, 28, etc. Successively, the full color toner image is correctively transferred onto one side surface (an obverse surface) of recording material P by the secondary transferring roller 7A (secondary transferring operation).

The fixing apparatus 17 applies the fixing operation to the recording material P, to fix the full color toner image onto the recording material P. Then, the recording material P with the fixed toner image is tightly clipped and conveyed by a pair of ejecting rollers 24, so as to eject it onto an ejecting tray 25 disposed outside the apparatus. After the primary transferring operation is completed, residual toner remaining on the photoreceptor drums 1Y, 1M, 1C, 1K are removed and cleaned by the cleaning devices 8Y, 8M, 8C, 8K for cleaning the image forming elements, respectively, in order to enter the next image forming cycle.

In the duplex image forming mode, the recording material P, on one side surface (obverse surface) of which the image is already formed and which is ejected from the fixing apparatus 17, is branched from the paper sheet ejecting path by a branching gate 26, and enters into a reversing conveyance path 27B through a paper sheet circulating path 27A disposed downward. Successively, the obverse surface of the paper sheet P is turned to its reverse side by the reversing conveyance path 27B serving as paper sheet re-feeding mechanism (ADU mechanism). Then, the recording material P passes through a paper sheet re-feeding section 27C and enters into the pair of conveyance rollers 22D. Incidentally, the paper sheet circulating path 27A, the reversing conveyance path 27B and the paper sheet re-feeding section 27C constitute the paper sheet conveying section. The recording material P, conveyed in the reversing mode, is again conveyed into the secondary transferring roller 7A, so that another full color toner image is correctively transferred onto another side surface (a reverse surface) of recording material P by the secondary transferring roller 7A.

The fixing apparatus 17 applies the fixing operation to the recording material P on which the full color toner image is transferred, to fix the full color toner image onto the recording material P. Then, the recording material P with the fixed toner image is tightly clipped and conveyed by the pair of ejecting rollers 24, so as to eject it onto the ejecting tray 25 disposed outside the apparatus. On the other hand, after the full color toner image is transferred onto the recording material P by the secondary transferring roller 7A, residual toner, remaining on the intermediate transfer belt 6 after the recording material P is separated from it by the curvature separating action, are removed by a cleaning unit 8A for cleaning the intermediate transfer belt.

Figure 2:
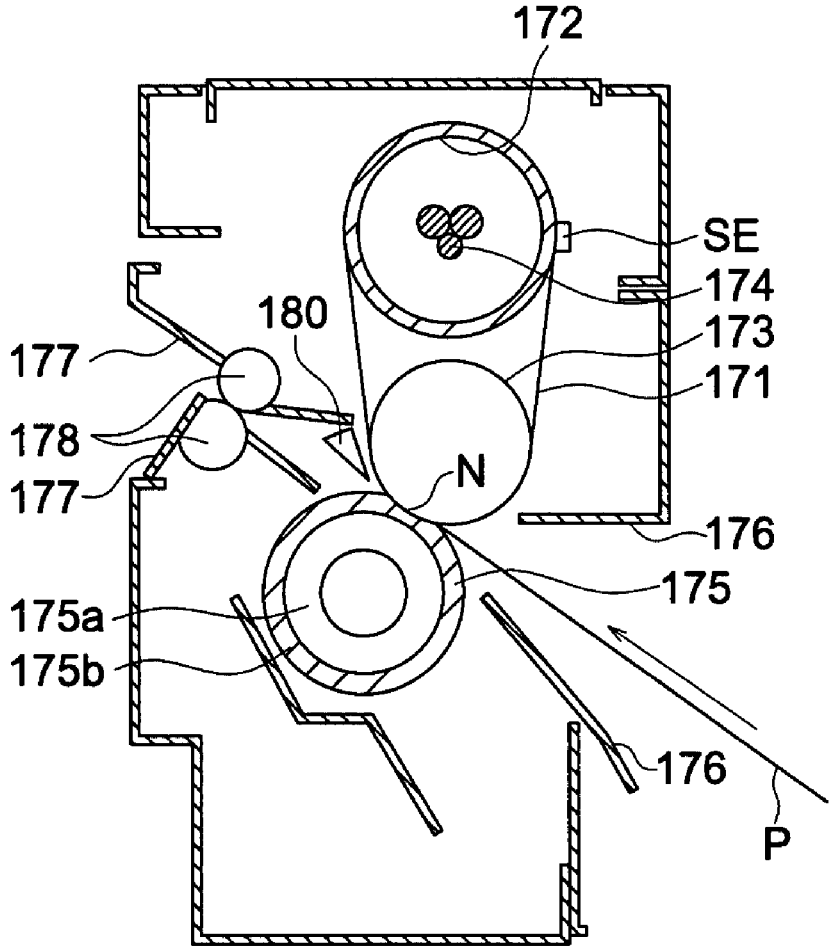
FIG. 2 shows a cross sectional view of a fixing apparatus shown in FIG. 1.
Figure 3:
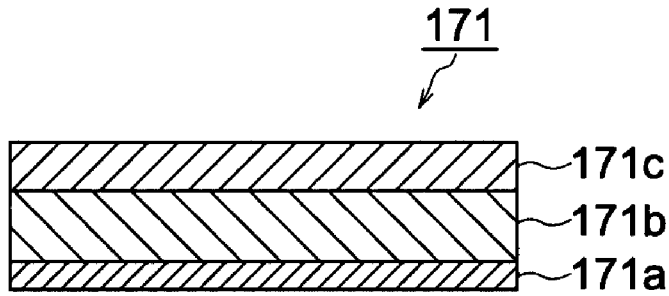
FIG. 3 shows a cross sectional view of a heating belt included in a fixing apparatus.
Figure 4:
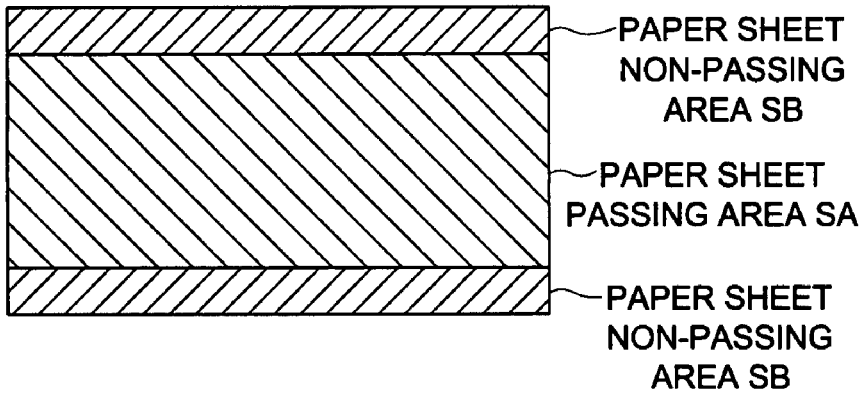
FIG. 4 shows a schematic diagram indicating a paper sheet passing area and a paper sheet non-passing area on a heating belt.

Referring to FIGS. 2-6, the fixing apparatus embodied in the present invention will be detailed in the following. FIG. 2 shows a cross sectional view of the fixing apparatus 17 shown in FIG. 1, FIG. 3 shows a cross sectional view of a heating belt 171 and FIG. 4 shows a paper sheet passing area and a paper sheet non-passing area.

In FIG. 2 and FIG. 3, numeral 171 indicates a heating belt that is constituted by a base member 171*a*, an elastic layer 171*b* and a surface layer 171*c*. The base member 171*a* is made of polyimide being a heat resistant material, the elastic layer 171*b* is made of silicone rubber being a heat resistant material and the surface layer 171*c* is made of a resin of tetrafluorethylene -perfluoroalkyl vinyl ether copolymer (hereinafter, referred to as a PFA, for simplicity) having both release and heat-resisting properties. The elastic layer 171*b* and the surface layer 171*c* are elastically deformable.

The PFA described in the Tokkai 2005-163837 (Japanese Non-Examined Patent Publication) can be cited as a preferable example of PFA to be employed for the surface layer 171*c*. Concretely speaking, the PFA, having a measuring value of elastic modulus (G') being equal to or smaller than 60 MPa, measured at 100° C. by the dynamic viscoelasticity measuring apparatus (ARES), is preferable. Incidentally, the PFA that is soft at a temperature more than 100° C. and has an elastic modulus (G') being equal to or smaller than 60 MPa as mentioned in the above is called a soft PFA.

It is desirable that the thickness of the surface layer 171*c* is in a range of 0.01-0.15 mm. Further, it is preferable that a content of perfluoroalkyl vinyl ether included in the soft PFA is in a range of 6-25%-by-mass.

Each of the elastic layer 171*b* and the surface layer 171*c* is formed by a coating process.

The surface states of a paper sheet passing area SA and a paper sheet non-passing area SB on the surface layer 171*c* are different from each other.

Concretely speaking, the surface of the surface layer 171*c* is formed in such a manner that surface roughness Ra of the paper sheet passing area SA is smaller than 0.1 μm, while surface roughness Ra of the paper sheet non-passing area SB is equal to or greater than 0.1 μm. The paper sheet passing area SA, whose surface roughness Ra is smaller than 0.1 μm, is formed by the normal coating process without applying any surface treatment, while the paper sheet non-passing area SB, whose surface roughness Ra is equal to or greater than 0.1 μm, is formed by applying a roughing process after the normal coating process is completed.

The paper sheet passing area SA is defined as an area in which the heating belt 171 contacts the recording material P, and accordingly, its width is equivalent to the maximum width of the recording material P to be used. The paper sheet non-passing area SB is defined as an area in which the recording material P does not contact the heating belt 171. Further, the surface roughness Ra is a measured value, which complies with JIS-B-0601 (equivalent to ISO4287). In this connection, it is not necessary to apply the roughing process to allover the paper sheet non-passing area SB, but it is sufficient to apply the roughing process to at least an area in which the temperature sensor directly contacts the surface of the heating belt 171. Accordingly, it is needless to say that the scope of present invention includes such the configuration as the above.

Numerals 172, 173 indicate supporting rollers, made of metal material, to support the heating belt 171, while numeral 174 indicates a heater. Since the supporting rollers 172, 173 are made of metal material, the heating belt 171 is heated by the heater 174 through the supporting roller 172.

Numeral 175 indicates a pressure roller that is constituted by a core body 175*a* and an elastic layer 175*b* made of silicone-rubber, and is urged by a spring (not shown in the drawings) so as to press-contact the heating belt 171. A nip N is formed by the press-contacting action mentioned in the above. Further, numeral 176 indicates a pair of introducing guide plates, numeral 177 indicates an ejecting guide plate and numeral 178 indicates a pair of ejecting rollers.

The recording material P is introduced into the fixing apparatus 17 in the direction indicated by the arrow. Successively, when the recording material P passes through the nip N, heat and pressure are applied onto the recording material P so as to fuse and fix the toner image onto the recording material P. The surface temperature of the heating belt 171 is detected by the temperature sensor. Although either a contact type temperature sensor that directly contact the surface of the heating belt 171 to detect its temperature, or a noncontact type temperature sensor that is disposed opposite to the surface of the heating belt 171 with a microscopic gap between them to detect its temperature, can be employed as the temperature sensor mentioned in the above, the noncontact type temperature sensor is employed for detecting the surface temperature of the paper sheet passing area SA on the heating belt 171, while the contact type temperature sensor is employed for detecting the surface temperature of the paper sheet non-passing area SB on the heating belt 171. As shown in FIG. 2, a temperature sensor SE that contacts the heating belt 171 is the contact type temperature sensor to be employed for detecting the surface temperature of the paper sheet non-passing area SB on the heating belt 171, and also serves as a temperature sensor used for temperature controlling operations or a temperature sensor used for overheat preventing operations.

Under the temperature controlling operations employing the temperature sensor, the fixing operation is implemented with the fixing temperature maintained at a certain constant value in a range of 150-210° C.

Figure 5:
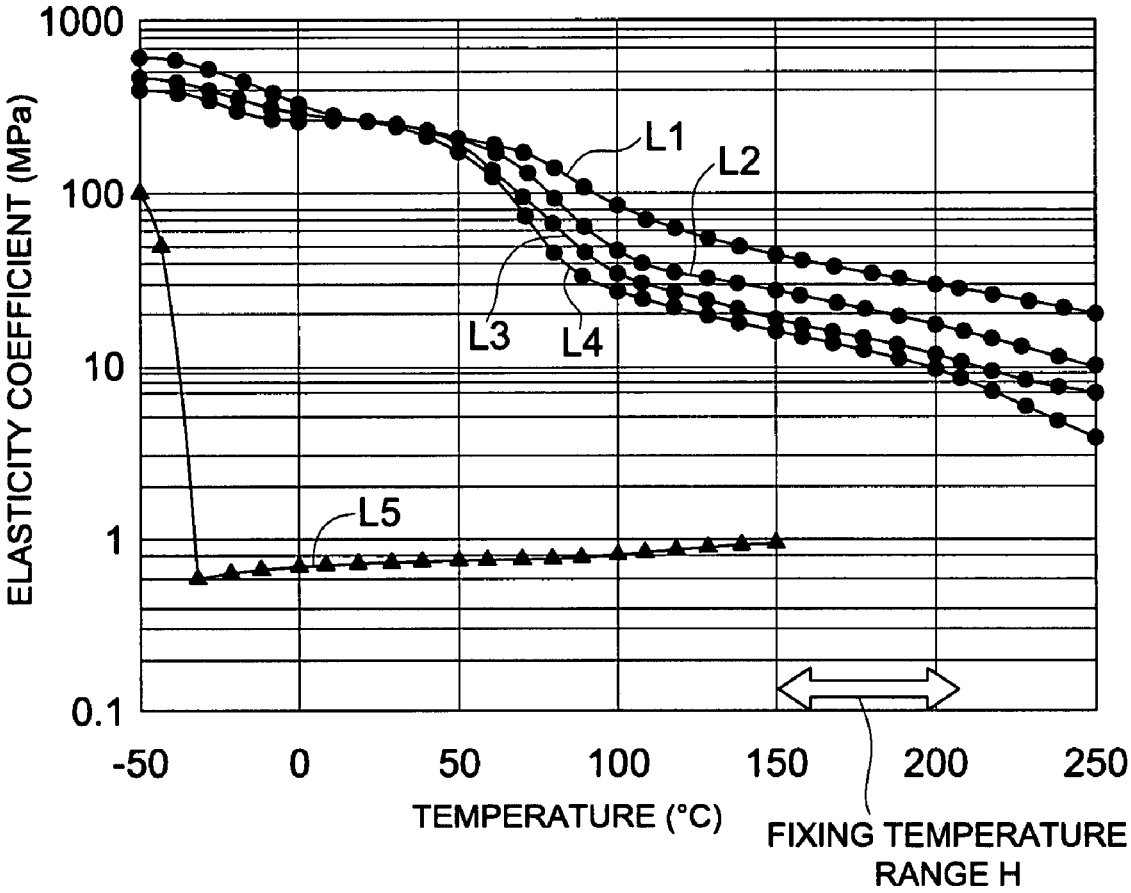
FIG. 5 shows a graph indicating transitions of elasticity coefficients versus temperature with respect to a conventional PFA, a soft PFA and a silicone rubber.
Figure 6:
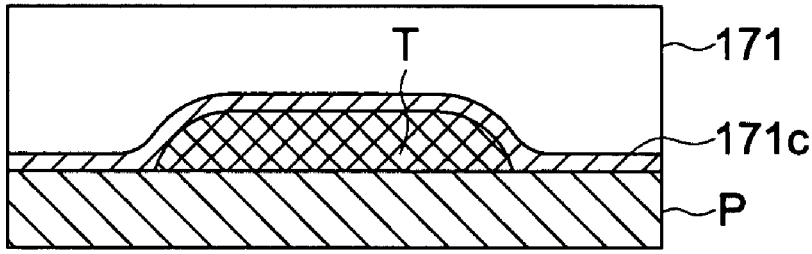
FIG. 6(*a*) and FIG. 6(*b*) show explanatory views for explaining a fixing operation.
Figure 6:
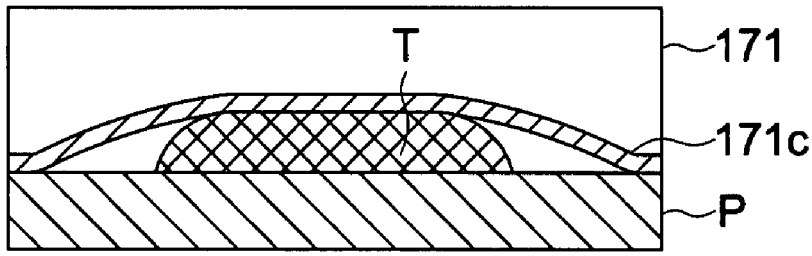

Referring to FIG. 2, FIG. 5 and FIG. 6, the fixing operation of the toner image, conducted by employing the soft PFA, will be detailed in the following. FIG. 6(*a*) and FIG. 6(*b*) show explanatory views for explaining the fixing operation and FIG. 5 shows a graph indicating transitions of elasticity coefficients versus temperature with respect to a conventional PFA, a soft PFA and a silicone rubber.

As shown in FIG. 6(*a*) and FIG. 6(*b*), when the recording material P passes through the nip N, the elastic layer 171*b* and the surface layer 171*c* are deformed by toner protrusions caused by a toner image T formed on the recording material P. When both the elastic layer 171*b* and the surface layer 171*c* are flexibly deformed so as to follow the contour of the toner image T and the surface layer 171*c* is tightly contacts both the toner image T and the recording material P as shown in FIG. 6(*a*), the heat is uniformly transmitted from the heating belt 171 to the toner image T, resulting in completion of a good fixing operation. However, when either elastic layer 171*b* or the surface layer 171*c* is relatively solid and hardly deformed, the surface layer 171*c* does not tightly contact the toner image T as shown in FIG. 6(*b*). Owing to the above, the thermal conduction from the heating belt 171 to the toner image T becomes ununiform, resulting in occurrence of a fixing defect, such as a fixing unevenness, unevenness of luster, etc.

As mentioned in the foregoing, the surface layer 171*c* of the heating belt 171 is made of the soft PFA, which exhibits a low elastic coefficient at a high temperature equal to or greater than 100° C. and becomes soft.

In FIG. 5, curve lines L1, L2 indicate elastic coefficient transitions of the conventional PFAs, curve lines L3, L4 indicate elastic coefficient transitions of the soft PFAs and a curve line L5 indicates an elastic coefficient transition of the silicone rubber.

As shown in FIG. 5, each of the PFAs has a high elastic coefficient and is hardly deformed, compared to the silicone rubber. Further, each of the soft PFAs has a low elastic coefficient, compared to the conventional PFA. As explained referring to FIG. 6, the more deformable the surface layer contacting the toner image is, the better the result of the fixing operation becomes. Further, in order to utilize the efficiency of the elastic layer 171*b* made of silicone rubber and serving as a lower layer, the smaller the difference between an elastic coefficient of the surface layer 171*c* and another elastic coefficient of the elastic layer 171*b* is made, the better the result of the fixing operation becomes.

Compared to the conventional PFA, the elastic coefficient of the soft PFA is considerably approximate to that of the silicone rubber at a fixing temperature in a range of 150-210° C., indicated by the whitespace arrow shown in FIG. 5. Accordingly, in the practical fixing operation, a good result of the fixing operation could be obtained by employing the soft PFA.

However, when the temperature sensor SE is made to contact the surface layer 171*c* being flexible and deformable, the surface of the heating member is deformed and the temperature sensor SE interlocks with the surface layer, due to the frictional resistance generated between the heating belt 171 and the temperature sensor SE. Accordingly, there has occurred such a phenomenon that the temperature sensor SE did not smoothly slide on the heating belt 171.

Owing to the above defects, various kinds of defects, such as occurrences of abnormal sounds, breaking of a wire coupled to the temperature sensor, an increase of driving torque for driving the heating member, etc., have been generated during the operating time of the fixing apparatus.

However, such the defects mentioned in the above can be eliminated by increasing the surface roughness of the area at which the temperature sensor SE contacts the heating belt 171, namely, the paper sheet non-passing area SB at which the heating member does not contact the recording material P (refer to FIG. 4), and by reducing the frictional resistance generated between them.

Since it is necessary that the paper sheet passing area SA has a prescribed release property to prevent the toner adhering phenomenon, and in order to achieve a high glossiness of the fixed image, the surface roughness of the paper sheet passing area SA is set at a value equal to or smaller than a predetermined value.

As a result of intensive experiments conducted by the present inventors, the invertors have confirmed that it becomes possible to conduct a good fixing operation without generating the defects mentioned in the above, by finishing the surface of the heating belt 171 in such a manner that the surface roughness of the paper sheet non-passing area SB is coarser than that of the paper sheet passing area SA.

In other words, it has been confirmed that, by setting the surface roughness Ra of a partial surface layer corresponding to the paper sheet passing area SA, in which the heating belt 171 contacts the recording material P, at a value smaller than 0.1 μm, while by setting the surface roughness Ra of another partial surface layer corresponding to the paper sheet non-passing area SB, in which the heating belt 171 does not contact the recording material P, at a value equal to or greater than 0.1 μm, it becomes possible to securely prevent occurrences of the aforementioned defects, resulting in implementation of a good fixing operation.

Further, by setting the surface roughness Ra of the surface layer 171*c* corresponding to the paper sheet passing area SA at a value smaller than 0.08 μm, while by setting the other surface roughness Ra of the surface layer 171*c* corresponding to the paper sheet non-passing area SB at a value equal to or greater than 1.02 μm, it becomes possible to prevent occurrences of the aforementioned defects more securely than the above.

The scope of the present invention is not limited to the embodiment described in the foregoing. Various kinds of modifications of the present embodiment can be proposed by a skilled person without departing from the spirit and scope of the invention.

For instance, it is also applicable that a heating roller is employed as the heating member, instead of the heating belt, and a pressure belt is employed in the fixing apparatus, instead of the pressure roller.

EXAMPLES

The image forming operations were conducted by employing the fixing apparatus shown in FIG. 2, while setting the operating conditions and factors of the fixing apparatus for every example and for every comparison example, as described in the following. In this connection, a sandpaper of #800 was employed for the roughing process of the paper sheet non-passing area SB of the surface layer 171*c*.

(1) Example 1

Press-pushing load of temperature sensor SE: 30 gram

Coating material of temperature sensor surface (insulation tape): Kapton® (polyimide film manufactured by DuPont)

Surface layer of heating belt 171: soft PFA manufactured by DuPont-Mitsui Fluorochemicals company, Ltd.

Surface roughness Ra of surface layer 171*c* corresponding to paper sheet non-passing area SB: 0.15 μm Surface roughness Ra of surface layer 171*c* corresponding to paper sheet passing area SA: 0.06 μm Surface temperature of heating belt 171: 180° C.

Line velocity of heating belt 171: 300 mm/sec.

(2) Example 2

Same as those of EXAMPLE 1, except

Press-pushing load of temperature sensor SE: 80 gram

(3) Example 3

Same as those of EXAMPLE 1, except

Press-pushing load of temperature sensor SE: 80 gram

Coating material of temperature sensor surface (insulation tape): glass cloth film

(4) Example 4

Same as those of EXAMPLE 1, except

Coating material of temperature sensor surface (insulation tape): glass cloth film

(5) Example 5

Same as those of EXAMPLE 1, except

Press-pushing load of temperature sensor SE: 80 gram

Coating material of temperature sensor surface (insulation tape): Teflon® (manufactured by DuPont)

(6) Example 6

Same as those of EXAMPLE 1, except

Coating material of temperature sensor surface (insulation tape): Teflon® (manufactured by DuPont)

(7) Comparison Example 1

Same as those of EXAMPLE 1, except

Surface roughness Ra of surface layer 171*c* corresponding to paper sheet non-passing area SB: 0.06 μm

(8) Comparison Example 2

Same as those of EXAMPLE 2, except

Surface roughness Ra of surface layer 171*c* corresponding to paper sheet non-passing area SB: 0.06 μm

(9) Comparison Example 3

Same as those of EXAMPLE 3, except

Surface roughness Ra of surface layer 171*c* corresponding to paper sheet non-passing area SB: 0.06 μm

(10) Comparison Example 4

Same as those of EXAMPLE 4, except

Surface roughness Ra of surface layer 171*c* corresponding to paper sheet non-passing area SB: 0.06 μm

(11) Comparison Example 5

Same as those of EXAMPLE 5, except

Surface roughness Ra of surface layer 171*c* corresponding to paper sheet non-passing area SB: 0.06 μm

(12) Comparison Example 6

Same as those of EXAMPLE 6, except

Surface roughness Ra of surface layer 171*c* corresponding to paper sheet non-passing area SB: 0.06 μm As a result of the image forming operations for 40,000 paper sheets of A4 size under the conditions of each of the EXAMPLES 1-6 and the COMPARISON EXAMPLES 1-6 mentioned in the above, with respect to the EXAMPLES 1-6 in each of which the roughing process is applied to the paper sheet non-passing area SB where the temperature sensor SE contacts the surface layer 171*c*, good images could be formed without generating abnormal sounds caused by the friction between the temperature sensor SE and the surface layer 171*c* and without breaking the wire coupled to the temperature sensor. However, with respect to the COMPARISON EXAMPLES 1-6 in each of which the roughing process is not applied to the paper sheet non-passing area SB, owing to various kinds of defects, such as abnormal sounds, breaking of a wire coupled to the temperature sensor, etc., occurring in the mid-course of image forming operations, it was impossible to continue the image forming operations up to the final paper sheet.

According to the present embodiment, by setting the surface roughness Ra of the heating member, corresponding to the paper sheet non-passing area where the contact type temperature sensor directly contacts the heating member, at a value equal to or greater than 0.1 μm, it becomes possible not only to reduce the frictional resistance generated between the temperature sensor and the heating member, but also to prevent occurrences of the abnormal sounds and breaking of the wire coupled to the temperature sensor, both caused by the direct contact between them. Further, it also becomes possible to appropriately suppress the increase of the driving torque of the heating member, and accordingly, it becomes possible to provide an image forming apparatus, which makes it possible to form high quality images over a long term.

While the preferred embodiments of the present invention have been described using specific term, such description is for illustrative purpose only, and it is to be understood that changes and variations may be made without departing from the spirit and scope of the appended claims.

What is claimed is:

1. A fixing apparatus for fixing an image onto a recording material, comprising:

a heating member that is provided with a base member and an elastic layer on which a surface layer is formed, wherein the surface layer is elastically deformable and includes a paper sheet passing area that directly contacts the recording material and a paper sheet non-passing area that does not contact the recording material;

a pressing member that press-contacts the heating member; and a temperature sensor that contacts the paper sheet non-passing area of the surface layer;

wherein a value of a surface roughness Ra of the paper sheet non-passing area is larger than that of the paper sheet passing area and wherein the surface layer is made of a resin of tetrafluorethylene-perfluoralkyl vinyl ether copolymer (PFA), having a measuring value of elastic modulus (G') being equal to or smaller than 60 Mpa, measured at 100° C. by a dynamic viscoelasticity measuring apparatus (ARES).

2. The fixing apparatus of claim 1, wherein the pressing member is provided with a core body and an elastic layer formed on the core body.

3. The fixing apparatus of claim 1, wherein the temperature sensor is employed for controlling a temperature of the heating member.

4. The fixing apparatus of claim 1, wherein the temperature sensor is employed for preventing an overheat of the heating member.

5. The fixing apparatus of claim 1, wherein the surface layer has a surface processed by a roughing treatment in the paper sheet non-passing area.

6. The fixing apparatus of claim 1, wherein the surface roughness Ra of the paper sheet passing area is set at a value smaller than 0.1 μm, while surface roughness Ra of the paper sheet non-passing area is set at another value equal to or greater than 0.1 μm.

7. The fixing apparatus of claim 1, wherein the heating member is further provided with an elastic layer on which the surface layer is formed; and wherein the elastic layer is made of a silicone rubber.

8. The fixing apparatus of claim 1, wherein a contact surface of the temperature sensor, which directly contacts the surface layer, is coated with a polyimide film.

9. An image forming apparatus, comprising:

an image forming section to form a toner image on a recording material; and a fixing apparatus to fix the toner image onto the recording material;

wherein the fixing apparatus includes:

a heating member that is provided with a base member and an elastic layer on which a surface layer is formed, wherein the surface layer is elastically deformable and includes a paper sheet passing area that directly contacts the recording material and a paper sheet non-passing area that does not contact the recording material;

a pressing member that press-contacts the heating member; and a temperature sensor that contacts the paper sheet non-passing area of the surface layer and;

wherein a value of a surface roughness Ra of the paper sheet non-passing area is larger than that of the paper sheet passing area; and wherein the surface layer is made of a resin of tetrafluorethylene-perfluoralkyl vinyl ether copolymer (PFA), having a measuring value of elastic modulus (G') being equal to or smaller than 60 MPa, measured at 100° C. by a dynamic viscoelasticity measuring apparatus (ARES).

10. The image forming apparatus of claim 9, wherein the pressing member is provided with a core body and an elastic layer formed on the core body.

11. The image forming apparatus of claim 9, wherein the temperature sensor is employed for controlling a temperature of the heating member.

12. The image forming apparatus of claim 9, wherein the temperature sensor is employed for preventing an overheat of the heating member.

13. The image forming apparatus of claim 9, wherein the surface layer has a surface processed by a roughing treatment in the paper sheet non-passing area.

14. The image forming apparatus of claim 9, wherein the surface roughness Ra of the paper sheet passing area is set at a value smaller than 0.1 μm, while surface roughness Ra of the paper sheet non-passing area is set at another value equal to or greater than 0.1 μm.

15. The image forming apparatus of claim 9, wherein the heating member is further provided with an elastic layer on which the surface layer is formed; and wherein the elastic layer is made of a silicone rubber.

16. The fixing apparatus of claim 9, wherein a contact surface of the temperature sensor, which directly contacts the surface layer, is coated with a polyimide film.

* * * * *